US007980761B2

(12) United States Patent
Fultcher et al.

(10) Patent No.: US 7,980,761 B2
(45) Date of Patent: Jul. 19, 2011

(54) SLEEVE

(75) Inventors: Andrew Fultcher, Bradford (GB); Timothy Hutchinson, Bradford (GB)

(73) Assignee: Storsack Dorton Limited, Buttershaw, Bradford (GB)

( * ) Notice: Subject to any disclaimer, the term of this patent is extended or adjusted under 35 U.S.C. 154(b) by 810 days.

(21) Appl. No.: 11/909,967

(22) PCT Filed: Mar. 31, 2005

(86) PCT No.: PCT/GB2005/001262

§ 371 (c)(1),
(2), (4) Date: Dec. 18, 2007

(87) PCT Pub. No.: WO2006/103378

PCT Pub. Date: Oct. 5, 2006

(65) Prior Publication Data

US 2008/0193707 A1 Aug. 14, 2008

(51) Int. Cl.

| | |
|---|---|
| ***B65D 30/00*** | (2006.01) |
| ***B65D 33/24*** | (2006.01) |
| ***B65D 30/08*** | (2006.01) |
| ***B65D 33/02*** | (2006.01) |

(52) U.S. Cl. ..... 383/4; 383/86; 383/111; 383/119

(58) Field of Classification Search ..... 383/4, 111, 383/119, 86; 190/107, 127; 229/87.02; 5/626, 5/627

See application file for complete search history.

(56) References Cited

U.S. PATENT DOCUMENTS

| | | | | |
|---|---|---|---|---|
| 2,254,578 | A * | 9/1941 | O'Brien | 190/107 |
| 4,307,764 | A | 12/1981 | Nattrass | 150/1 |
| 4,629,040 | A * | 12/1986 | Jones | 190/102 |
| 4,655,329 | A * | 4/1987 | Kaneko | 190/107 |
| 4,822,179 | A | 4/1989 | Nattrass | 383/17 |
| 5,002,401 | A | 3/1991 | Blackman | 383/38 |
| 5,031,734 | A * | 7/1991 | King | 190/122 |
| 5,103,945 | A * | 4/1992 | Kaneko | 190/107 |

(Continued)

FOREIGN PATENT DOCUMENTS

| | | |
|---|---|---|
| GB | 2 301 087 | 11/1996 |

(Continued)

OTHER PUBLICATIONS

Authorized Officer: Maria Zinburgova, *The International Search Report and the Written Opinion of the International Searching Authority*, International Application No. PCT/GB2005/001262, International Searching Authority, Dec. 23, 2005, 13 pages.

*Primary Examiner* — Jes F Pascua
(74) *Attorney, Agent, or Firm* — Sunstein Kann Murphy & Timbers LLP

(57) ABSTRACT

The present invention relates to a transport sleeve (1) or sack which is formed of a single fiber web or by sewing up or otherwise fastening two or more webs or sheets of fabric or fiber to form a protective cover (2,3,4) which can be wrapped around sheet material (13). The fabric or fiber cover can then be fastened in the form of a bag or sleeve to protect the sheet material. One variant of the present invention therefore relates to a sleeve in the shape of a bag which is either preformed by sewing up or otherwise fastening two or more fabric webs or sheets of synthetic material (2,3,4) together and folding them around a sheet of material (13) to be transported, or is obtained by folding over a single web of material around the sheet material.

15 Claims, 3 Drawing Sheets

U.S. PATENT DOCUMENTS

| | | | | |
|---|---|---|---|---|
| 5,319,874 | A * | 6/1994 | Vance | 43/26 |
| 5,323,922 | A | 6/1994 | Lapoint, Jr. et al. | 220/4.28 |
| 5,437,507 | A | 8/1995 | Blumenkron | 383/107 |
| 5,857,778 | A * | 1/1999 | Ells | 383/5 |
| 6,074,093 | A * | 6/2000 | Anderson | 383/4 |
| 6,209,723 | B1 | 4/2001 | Fields | 206/373 |
| 6,244,399 | B1 * | 6/2001 | Birkestrand | 190/103 |
| 7,451,861 | B2 * | 11/2008 | Bhavnani | 190/107 |
| 2002/0036151 | A1 | 3/2002 | Deiger | 206/449 |
| 2003/0221978 | A1 | 12/2003 | Redzisz | 206/278 |
| 2004/0221392 | A1 * | 11/2004 | Tsai | 5/626 |

FOREIGN PATENT DOCUMENTS

| | | |
|---|---|---|
| JP | 07206059 | 8/1995 |

* cited by examiner

SLEEVE

The present invention relates to a transport sleeve or sack which is formed of a single fibre web or by sewing up or otherwise fastening two or more webs or sheets of fabric or fibre to form a protective cover which can be wrapped around sheet material. The fabric or fibre cover can then be fastened in the form of a bag or sleeve to protect the sheet material. One variant of the present invention therefore relates to a sleeve in the shape of a bag which is either preformed by sewing up or otherwise fastening two or more fabric webs or sheets of synthetic material together and folding them around a sheet of material to be transported, or is obtained by folding over a single web of material around the sheet material.

As used herein, the term fabric means a web of woven material such as a web formed from woven polypropylene fibre. Similarly, a fibre web refers to a web woven from synthetic fibres. The variants of the invention are intended for the transportation of thin elongated materials ie sheet materials which are to be protected from damage. More particularly, the invention relates to a sleeve for transportation of articles whose edges or surfaces require protection such as kitchen work tops, doors and slate or similar objects, glass sheets and sheets of marble etc. The sleeve or sack is thus in the form of an elongated bag which protects the sides and edges of the enclosed article or in the form of a sheet that can be wrapped around the article.

Kitchen work tops, for example, are usually packaged in a thin plastics film to prevent the ingress of dust and moisture. The plastics film is usually shrunk around the work top to provide a tight fitting protective cover. Some manufacturers also include plastic or cardboard supports at the corners of the work top surface which are encased within the shrunken plastic film.

Alternatively, work tops can be provided in cardboard wrapping, usually in the form of an elongated box or in the form of two sheets of cardboard one disposed either side of the work top surface these then being held in place by strapping or tape around the outer surfaces of the cardboard and the work top.

One disadvantage with such conventional means of protecting work tops is that they do not provide adequate protection against impact. Thus, in the case of a protective plastics film the film does not provide any significant protection against impact by another work top or other articles or impacts which are sustained during the normal handling and transportation and storage of the work tops. Even when plastic or cardboard corner pieces are included, both the long edges and the side edges of the work top are effectively exposed to damage such as chipping. The same is true of the top and underside of the work top. Although plastics films have the advantage that they provide a degree of protection from water and moisture, plastics films are easily torn or punctured by sharp objects and thus their integrity is compromised during normal handling and storage. In the case of a cardboard sleeve, the situation is only marginally improved. Corrugated cardboard sleeving provides a slightly better degree of impact protection than a plastics film but is still easily punctured on impact with other articles. The cardboard protective sheet is easily torn and is also significantly weakened on contact with moisture or if contacted by water. Cardboard suffers the disadvantage that once wet it loses all strength.

GB 2301087 describes a transport sack which is formed by sewing up one or several fabric webs by means of edge seams in order to provide a leak-proof seam. The sack of this material is substantially square in cross-section and is intended for the transportation of pourable materials such as bulk powders. This patent is primarily concerned with providing a leak-proof seam by incorporating a sealing strip into the seam between the fabric webs so that the pourable materials do not escape from the package.

U.S. Pat. No. 5,437,507 discloses a bag which is made by stitching opaque fabric material and is intended to provide a bag which has very high sealing tightness in the seam region.

U.S. Pat. No. 4,307,764 discloses a bag for the transportation of bulk materials which has an open top of approximately the same cross-sectional area as the lower part of the bag. The bag is intended to be sufficiently strong to carry heavy loads of powdered or granulated material.

U.S. Pat. No. 4,822,179 discloses semi-bulk transport bags having wide lifting members which are formed from a plural layer folded strip of plain fabric woven from flat ribbon tape. The lifting members are relatively stiff and anchored at the top of the bags and are positioned so as to distribute lifting stresses across wide segments of the side panels of the bags. The bags are of rectangular or circular shape and are intended for the transportation of powders and granular materials.

U.S. Pat. No. 5,002,401 discloses a box-like container for storage of small items. The carrier has four fabric wall panels and a base, each containing an insert of soft, pliable material and a draw-string closure at one end. This patent is primarily concerned with providing an article holder and carrier to organise and secure school supplies such as pens, scissors and coins.

US 2003/0221978 describes a hanging organiser and storage device. It is fabricated from plastic board and circumferential wire encapsulated in fabric, with hanging means on the back side and pockets on the front side so it can be suspended from a panel or door. The device is intended to provide a portable means for organising office and household items.

US 53239212 discloses a collapsible bag-like container for transporting and storing bulk materials of up to 70% liquid composition. The bag is made rigid when used for storage by insertion of stiffening members into sewn pockets in the wall material and tying on a cover for transverse rigidity. The stiffening members are removed from the pockets and placed inside the bag when the bag is to be collapsed.

The present invention seeks to improve on the prior art arrangements.

According to the present invention, there is provided a fibre web adapted for transporting sheet material, the fibre web having a base layer of woven fibre comprising:

- a first protective region adapted to cover one of the two largest faces of the sheet material;
- a second protective region adapted to cover the other of the largest faces of the sheet material; and
- wherein at least one of the first and second protective regions includes a second layer formed of plastics material which is retained in contact with at least part of the base layer but which is not bonded to the base layer;

the fibre web characterised in that:

- the plastics material is retained in contact with at least part of the base layer by at least one region of an overlapping fibre web configured to cover a portion of an outer surface of the plastics material capable of positioning in contact with one of the two largest faces of the sheet material during use, wherein a portion of the outer surface of the plastics material is exposed, such that the plastics material can be replaced.

The present invention provides an improved protective covering for articles such as work tops which are susceptible to damage and provides a number of advantages. The protective cover is strong and resistant to tearing. The protective cover also provides a barrier to the ingress of dirt and moisture and it does not lose strength on contact with water. The protective cover is able to provide protection against impacts sustained during handling, transportation and storage. It is relatively cheap and easy to manufacture, and ideally can also be re-used a number of times. After it has been used a number of times the component materials can easily be separated from one another and then recycled or reused as separate components.

It is intended that the product be as environmentally friendly as possible in the sense that it is intended to be reused so preventing disposable single trip waste packaging and avoiding UK packaging waste levies after its first trip. Even when damaged it is made from recyclable materials and thus and will be recyclable, whereas the current methods of packaging have plastic and cardboard mixtures and thus are not easily recyclable. A further advantage is that if one of the base layer or the plastics sheet wears before the other, the one that is worn can be replaced without needing to replace the whole package. This would be difficult or impossible to achieve if the components are bonded together with adhesive. The sleeve is easy to handle in the sense that it is easy to introduce the product into the sleeve and also to retrieve the product from the sleeve. The article, once enclosed in the sleeve, is easy to transport.

The present invention also relates to the use of a fibre web or sleeve constructed as described above for carrying bulky articles.

The article can simply be laid on the unfolded fibre web (which is in the form of a sheet) and then enclosed or easily introduced into a bag like sleeve because of its relative rigidity. Also it aids the handling and carrying by the warehouse personnel.

The sleeve of the present invention may be constructed of a single web of fibre suitably folded and including stitched seams. Alternatively, the sleeve may be formed of more than one fibre web fastened together by seams. The seams may be formed by thermobonding or stitching, with stitched seams being preferred.

Kitchen worktops and other sheet materials to be transported are usually rectangular in shape with a pair of long edges and a pair of short edges. The sleeve of the present invention is designed to provide a fairly close-fitting cover for such materials. Thus, in practice, the first and second regions are slightly larger in length and width than the corresponding dimensions of the largest face of the sheet material.

The plastics material is retained in contact with the corresponding protective region without the need for bonding with adhesive by folding over a portion of the fibre web of the base layer or one or more fibre webs fastened thereto along some or all of the sides of the plastics sheet to form overlapping portions and stitching or thermobonding the edges of the overlapping portions to the base layer. Stitching is preferred.

Thus the plastics sheet is retained in contact with the base layer by covering a portion of the exposed (outer) surface of the plastics sheet with one or more webs of material so they overlap part of the plastics sheet and then stitching the edges of the or each web to the base layer. In this context outer surface of the plastics sheet refers to the surface which eventually forms an interior surface of the package in use and which will be in contact with the material being transported. In this manner the plastics sheet is mechanically trapped in place but is not actually bonded to the base layer. The web folded over the edge of the plastics sheet need not extend along the entire length of the edge. Thus there may be a continuous or an interrupted coverage of any particular edge. The important function the webs of overlapping material perform is to retain the plastics sheet in place. Thus, the overlapping portions only need to be large enough to fulfill this purpose. The plastics sheets can be slid or sprung out when desired. In one embodiment, it is sufficient for the corners of the plastics sheet to be retained. This can be achieved by using triangular overlapping portions. Alternatively, the whole of the surface of the plastics sheet (which would form the interior of the package) could be covered.

The overlapping webs of material may be part of the web of material forming the underlying base layer or may be separate webs of material which are stitched to the base layer.

The first and second protective regions may be joined directly to one another or which may be joined to one another via a third region. The joint may be formed either along both long edges or both short edges of the first and second regions. The third region may include a plastics sheet overing all or part of the base layer of the third region.

Preferably the third region is present. Ideally, the third region is of a size corresponding with the size of the face of the sheet material which is between the two largest faces this face being defined by the edge of the first and second regions which are joined. Hence, if the first and second regions are to be joined along their largest sides via the third region then the largest side face of the sheet material is covered by the third region when present.

In one embodiment, the web forming the sleeve, whether formed from a single web of material or from more than one web stitched together, is provided in the form of a substantially flat sheet of material. This form can be described as effectively an "open form" of the sleeve and the material is substantially flat except for the occurrence of seams. The edges of the web of material may also be folded over and stitched to form a hem for added strength.

In an embodiment there is no need to provide seams to separate the first, second, and third regions or the sealing region(s). Seams formed by stitching etc may be provided however to separate the different regions. Accordingly, the web representing the base layer and including the first, second, third and sealing regions may be formed of a single piece of material. As it is possible to include seams, if desired, the base layer may be formed of more than one fibre web fastened together by means of stitching or chemically bonded as desired.

In a preferred embodiment, both the first and second protective regions include a second layer of plastics material. Preferably the plastics material is polypropylene.

In an embodiment, the or each sealing region when present is provided with releasable fastening means to enable the or each sealing region to be fastened releasably to a corresponding surface of the base layer when the fibre web is suitably folded. Preferably, the fastening means is a touch-contact fastening. More preferably, the fastening means is selected from Velcro, a press-stud, a buckle, or an eyelet adapted to receive corresponding retaining means.

In another embodiment, the plastics material is corrugated plastics material. Preferably, the plastics material is corrugated polypropylene. This is a fluted material which has a high impact resistance and is very light. The material can be extruded in sheet format and cut to length. Additionally it has the advantage of being made from recycled materials. Preferably, the plastics material has a weight of 300 to 1100 $gm^{-2}$.

Replacement of either the base layer and overlapping material, or of the plastics sheet is facilitated because the plastics material is not bonded to the corresponding region of the base layer using adhesive. The presence of adhesive or other bonding means would be a disadvantage because separation of the two components would not be easily achieved. Also, there are cost and environmental benefits as a result of the construction of the present invention.

In another embodiment, the base layer is formed from woven synthetic fibre. Preferably the base layer is formed from woven polypropylene. The base layer can be coated on one or both sides. Ideally, it is coated on both sides for ease of cleaning. The weight of the base layer is preferably in the range 100 to 300 $gm^{-2}$, and more preferably in the range 160 to 240 $gm^{-2}$ because this provides the best compromise between folding ability and durability. Generally, the coating will account for a further 20 to 35 $gm^{-2}$ of the weight of the web. The coating is preferably a polypropylene coating. The advantage of coating the material on both sides is, on the one hand, that it leads to better bonding of the protective plastics layer to the base layer and, on the other hand, it means that the outer surface of the base layer is easier to clean and does not retain dirt in the fabric weave.

The coating is applied to the woven fabric by melting the material forming the coating, usually polypropylene, and feeding the molten material through a die in semi-molten form. The coating is then brought in sheet form into the locality of the fibre web and passed through a series of chilled rollers and tensioned in accordance with procedures well known in the art. The provision of a coating on both sides may be achieved in a two stage process or may be achieved in a single process.

A number of generally applicable features are now described below which are applicable to the fibre web of the present invention whether in the form of an open sheet or closed "bag-like" container ie sleeve.

In an embodiment, one or more fibre webs or sheets of fabric are bonded together to form a bag-like container. This is effectively a "closed form" of the fibre web and is ready to receive sheet material for transportation.

In the "open form" embodiment, the article to be transported, such as work top, can be laid onto the opened form of the sleeve and then the sleeve is wrapped around the article. Some or all of the corresponding edges of the sleeve when in folded form can be fastened by means of releasable fastenings such as clasps, buckles or Velcro. Alternatively, or in addition the two edges of the opened sheet of material which ultimately when folded form the ends may include Velcro fastening or eyelets through which a rope, wire or ties may be passed. This enables the sides and/or the two opposite ends to be joined.

Presently, there is a 10% rejection rate for kitchen work tops when packaged using conventional plastics or cardboard protective coverings. The packaging system of the present invention substantially reduces or eliminates this rejection rate.

In another embodiment, the fibre web or sleeve is provided with one or more handles or loops to facilitate lifting and handling of the sleeve when it contains an article. The handles can be in the form of loops of material which are stitched to the fabric web. Preferably, pairs of handles are provided at either end of the top of the sleeve or are fixed to either or both ends of the sleeve such that the sleeve can be carried by one or both ends. Thus a single web that can be lifted in both the horizontal and vertical plane may be fastened to the bottom ie the long thin side so that it provides means for carrying the sleeve which are effectively supported by the side ie the short thin side. The handle is secured at both ends of the sleeve and is threaded through a series of retaining loops, thus allowing the handle to be pulled in multiple directions to aid the carrying and handling process. In the embodiment in which a fully openable sleeve is provided, the loops are disposed such that corresponding handles are located close to either end of the sleeve once the sleeve has been folded into the closed formation.

In another embodiment, the sleeve may be in the form of a bag which has a single opening to permit introduction and removal of the article but which cannot be opened out into a single flat sheet of material. In this embodiment, the opening may be located in the top ie long edge or may be located in the side ie short edge. Preferably, the opening is in the top edge.

In another embodiment, the polypropylene web may incorporate a region which is adapted to carry identification marks relating to the goods such as the nature and weight of the goods, safety information and handling instructions.

The sleeve of the present invention is intended for carrying articles whose length is significantly longer than its width. Typically, an article intended to be transported by the sleeve of the present invention will be at least twice as long as it is wide. The sleeve is most suited to articles which are at least 3 times longer than they are wide. Articles intended to be carried by the sleeve are substantially thinner than the width of the article, usually at least 5 times thinner than the width. The sleeve is ideally suited to transporting articles whose thickness is at least 10 times thinner than the width. The sleeve is thus most suited to carrying articles such as kitchen work tops, bedroom doors and panels, sheets of glass or marble or slate and other delicate or fragile materials whose surfaces require protection.

The web of fibre or fabric is made of a flexible material, preferably a polymer. Ideally, the polymer is a polyolefin and is preferably polypropylene or polyethylene. The polymeric material is woven into a web from polymeric fibres. Ideally, the web is coated both sides with a waterproof coating to render it impervious to water and also to enhance the resistance to the ingress of dirt and other materials. Polypropylene has the advantage that it sufficiently strong to withstand the tensile forces that will occur when the sleeve is loaded and lifted. At the same time, the fabric should be sufficiently flexible so as to adopt the required shape but also be capable of being folded. Polypropylene is ideal for this purpose and is easily fabricated into different shapes.

Another important feature of the invention is the provision of eyelets in the polypropylene web of each of the various arrangements of the invention. The incorporation of eyelets is problematical since polypropylene may be prone to tearing because of disruption of the web once a hole has been formed for an eyelet. We have found that the weight of material is important in forming a suitable web. Ideally the weight of material should be in the range of 100 to 300 $gm^{-2}$. An optimum compromise between weight and strength is obtained when the material used as the basis for forming the sleeve has a weight of between 160 and 240 $gm^{-2}$. Of course, the weight of a sleeve when in open formation may be greater than this because material is crimped or bunched together to form a seam and the seam will be formed by stitching or by adhesion of two or more layers of material. In addition, as the seam may include a filler such as a corrugated strip to provide further shock resistance along the edges of the sleeve the total weight will thus be greater.

The nature of the fabric web is also important in ensuring sufficient strength. We have found that by using a laminated, for example 2-ply, material incorporation of attachment means such as eyelets or Velcro™ straps which are stitched to the material can be achieved without loss of strength in the web or without risk of the web tearing. Thus, in one embodiment, the web of fibre or fabric is a laminate which is formed from two or more layers of material. Preferably both layers are polypropylene. The two or more layers are arranged such that the fibre weave or direction in one layer is substantially orthogonal to the fibre weave or direction in an adjacent layer. More than two layers could be used and the nature of the fibre need not be the same in the or each layer. Thus different layers may be formed from different materials and/or different weave patterns or thicknesses of fibres. Also, the fibre directions need not be at 90° to each other in successive layers, the important feature being that adjacent layers do not have fibres running in exactly the same direction.

In another embodiment of the invention, the closure means comprises a number of eyelets disposed along some or all of the or each open edges of the fabric. The eyelets are adapted to receive a rope, cord or clip which may be passed through a number of eyelets disposed on different sides of the enclosed article. Thus, in the case of a sleeve formerly in the open state, and which has been folded into the closed state to encompass an article, there will be eyelets present in the web at the edge of the material present on either side of the article. Ideally, the eyelets should be positioned in the corresponding edges of the fabric web so that the eyelets are aligned when the sleeve is in the closed formation. Similarly, if Velcro fastening or another type of fastening is used the corresponding portions should be aligned such that they are able to meet and ensure closure of the edge when in the folded/closed confirmation.

In another embodiment of the present invention an attachment or lifting means comprises at least one displaceable hoop disposed near to the top edge of the fabric container. The or each hoop may be formed by folding a strip of material over and attaching both ends of the folded strip to the side of the container. The loops may be stitched or bonded chemically to the sleeve. Alternatively, the hoop could be formed by folding over the top edge of the fabric container and attaching it to the side of the container such that a hoop is formed along either part or the whole of the top edge on each side of the top edge. In either case, retaining straps hold the hoop close to the sleeve at one or more points but allow the hoop to move so that the hoop may effectively be used to lift the sleeve from different points.

We have also found that the nature of the fibre is important. Thus, if the fibre is fibulated ie a flat tape material is lightly cut or scored, irregularly, and then twisted to form the fibre then this leads to improved strength in the web, however a multifilament material can also achieve the same results.

The invention will now be described by reference to the following drawings in which.

Figure 1:
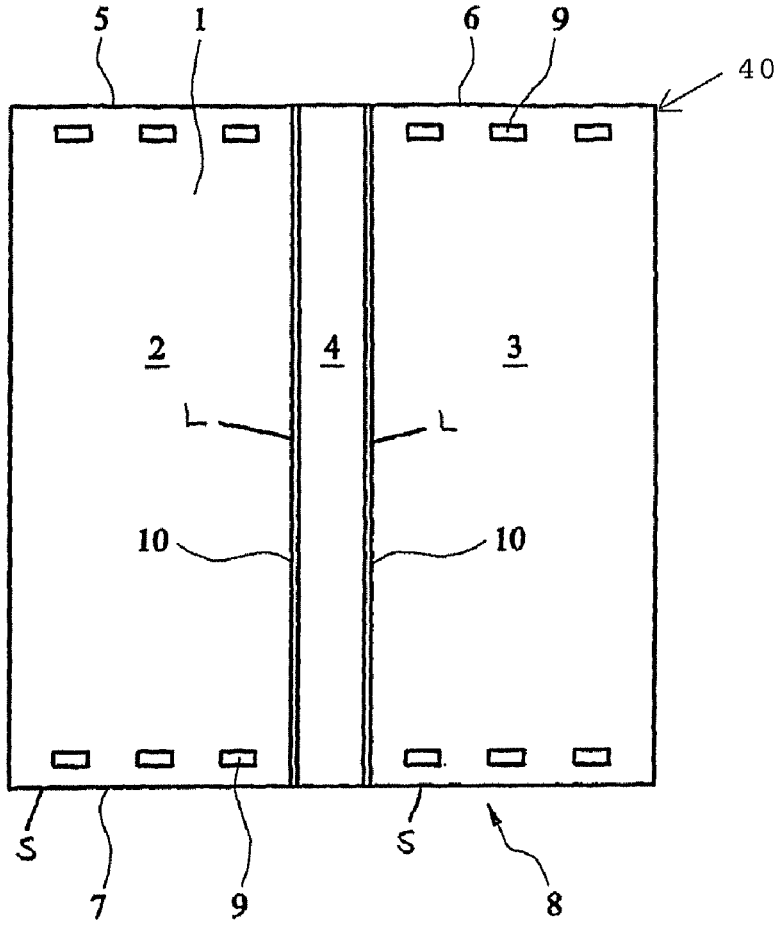
FIG. 1 illustrates a sleeve according to the invention (without the plastics sheet) in which the sleeve is in open formation.

FIG. 1 shows a sleeve 1 in open formation. The sleeve comprises three regions of fabric web, a first protective region 2, a second protective region 3, and a third region 4 joining the two protective regions. The long edges L of first 2 and second 3 regions are joined together via the third region 4 which may or may not also include a plastics sheet over the base layer 40 so that these regions form the side walls of the sleeve 1 when it is in its closed form. At the edges 5, 6, 7, 8 of the first 2 and second 3 regions are provided fastenings 9. Seams 10 are formed in the web of material so as to define regions 2, 3, 4. Seams 10 also serve to encourage the web to form a sleeve-like or bag-like confirmation when folded over an article. The regions 2 and 3 could equally be joined along their short edges S.

Figure 2:
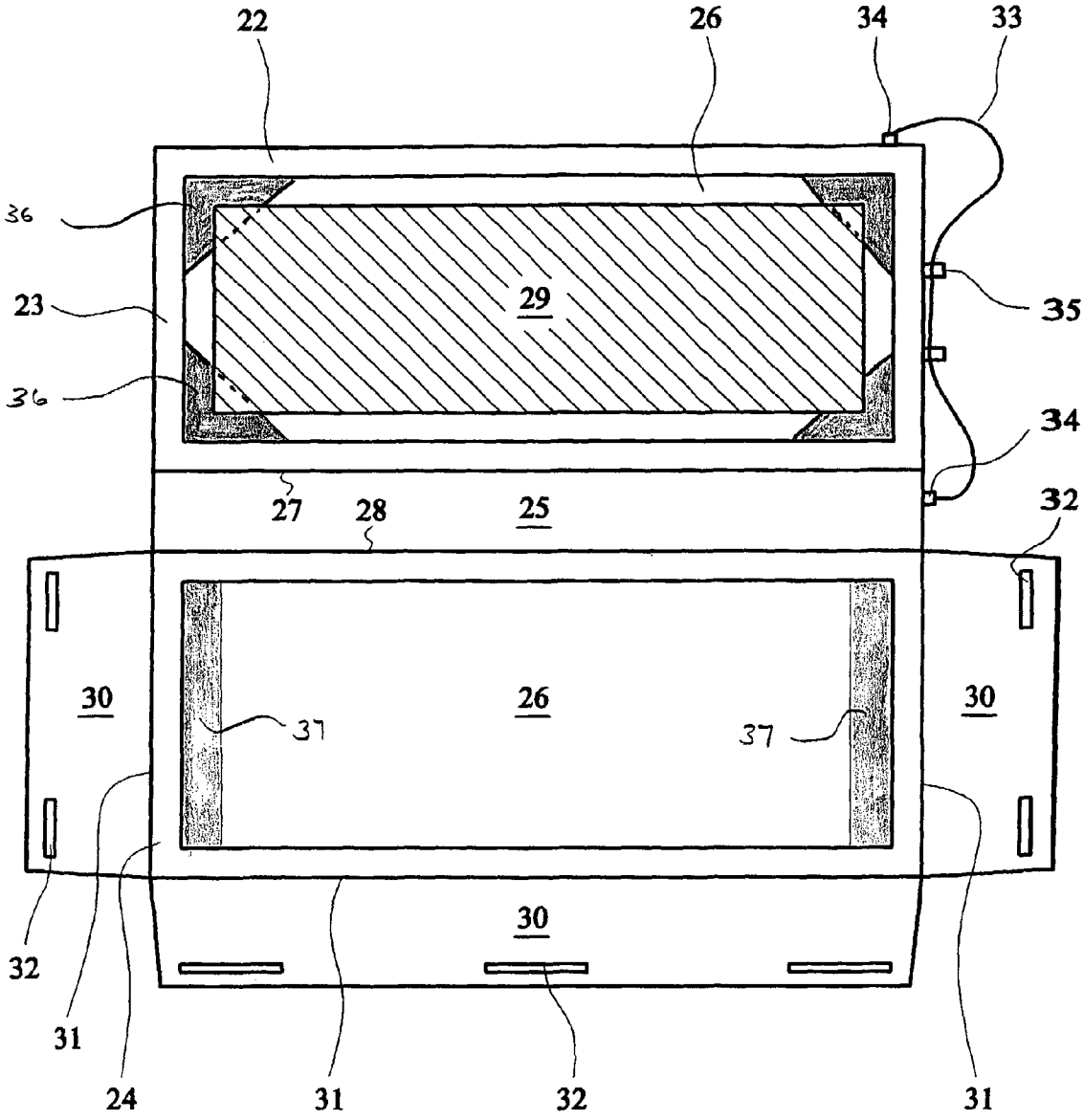
FIG. 2 illustrates a sleeve according to another aspect of the invention in which a fibre web is provided having protective regions.

FIG. 2 shows a sleeve according to the invention in which a transport sleeve is provided in the form of a sheet of material 22 which is formed of woven polypropylene. The woven polypropylene is coated on both sides. In the view shown, the sheet is opened out fully and laid on the ground. The sheet comprises three separate regions, a first protective region 23, a second protective region 24, and a third region 25 joining the two protective regions. In first region 23 and second region 24 are provided a layer of plastics material 26 which is corrugated polypropylene. The corrugated polypropylene more or less covers the entire area of first region 23 and second region 24 and is retained in place by means of portions of fabric web 36 which are fastened to the first protective region 23. In the embodiment shown the fabric portions 36 are triangular. However, other shapes would be suitable as can be seen in the fabric portions 37 illustrated for the second protective region 24. A layer of plastics material 26 is provided in second region 24 and substantially covers all of that region. Fold lines 28 are illustrated showing the points at which sheet 22 can be folded to wrap around a sheet of material 29 which has been placed on top of plastic layer 26 in the first region 23. In this particular view, fold lines 28 do not represent seams and are indistinguishable from adjacent parts of sheet 22 forming the base layer. The fold lines are illustrated simply to show the points at which sheet 22 may be folded and to illustrate the boundaries between first region 23, second region 24 and third region 25.

Adjoining the second region 24 are provided sealing flaps 30 which may be folded along fold lines 31 once sheet 22 has been folded along fold lines 28 to cover the sheet material 29. Once the sheet material has been folded along fold lines 28, sealing flaps 30 may be folded over the outside ie the bottom side (not shown) of sheet material 22 and fastened to that by means of Velcro™ strips 32. A loop of material 33 is secured at its ends 34 to suitable points on the first region 23 and further retaining loops 35 through which the loop 33 may pass serve to retain loop 33.

Figure 3:
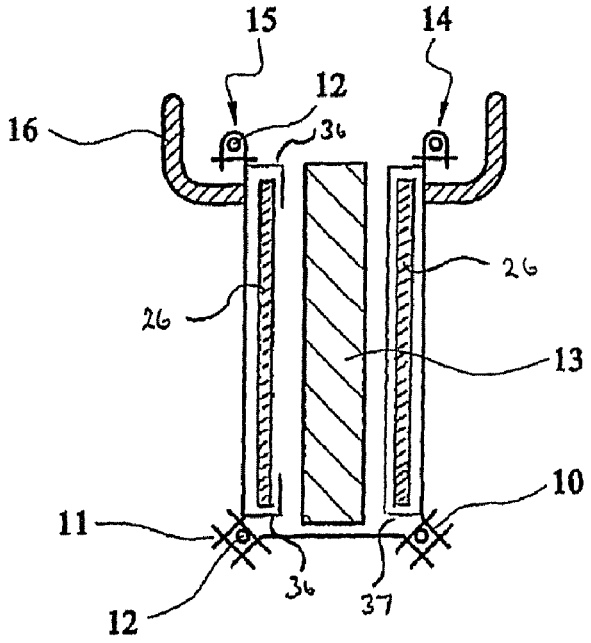
FIG. 3 illustrates in cross section the sleeve of FIG. 1 when in closed formation and containing a sheet of material.

FIG. 3 shows in cross section the sleeve 1 of FIG. 1 when in closed formation. In this view, it can be seen that the seams 10 are formed by two layers of overlapping fabric web which are fastened together. The seams are fastened together with stitching 11 and may optionally include a filler 12 to provide cushioning for the edges of the article 13 inside the bag. The top edges 14, 15 are folded over into a seam and may also optionally include a filler 12. Loops 16 of material forming lifting means are included at either end of the outside of top edges 14, 15 of the sleeve. The loops are attached by means of stitching. In an alternative embodiment (not shown) the top edges 14, 15 are folded over on themselves to form a loop and the top edges of the material are shaped so that the loop covers a part of or all of the length of top edges 14, 15 so as to provide a point for lifting.

Figure 4:
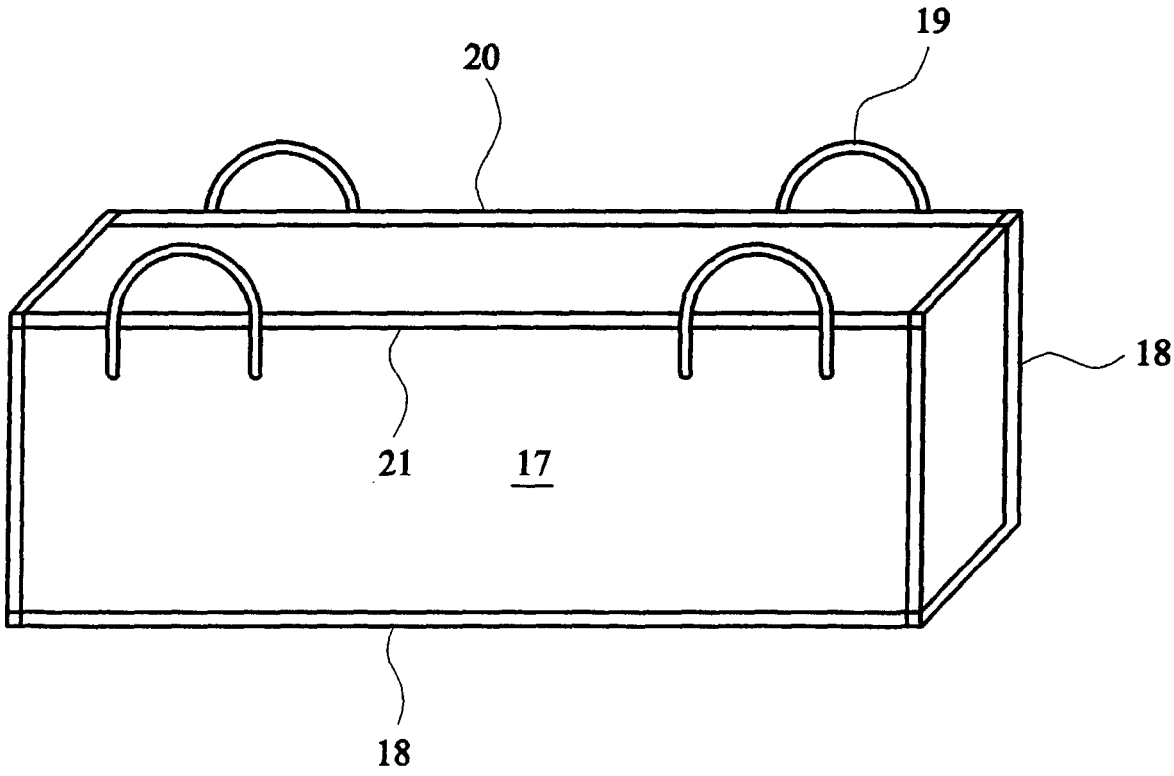
FIG. 4 is a side view of a sleeve according to the invention.

FIG. 4 shows the sleeve 17 is in the form of a bag but is not to scale and is of exaggerated width. The sleeve 17 had seams 18 at each edge. Loops of material 19 are provided at each end of top edges 20, 21 to allow lifting of the sleeve.

One advantage of the fibre web or sleeve of the present invention is that it allows articles to be stacked lying on their edges side by side or allows them to be stacked one on top of another such that one enclosed article can be removed from the vicinity of another enclosed article without tearing the protective sleeve and without damaging the article enclosed.

The invention claimed is:

1. A fire web adapted for transporting sheet material, the fibre web comprises a base layer of woven fibre comprising:

a first protective region adapted to cover one of the two largest faces of the sheet material;

a second protective region adapted to cover the other of the largest faces of the sheet material; and wherein at least one of the first and second protective regions includes a second layer formed of plastics material which is retained in contact with at least part of the base layer but which is not bonded to the base layer;

the fibre web characterised in that:

the plastics material is retained in contact with at least part of the base layer by at least one region of an overlapping fibre web configured to cover a portion of an outer surface of the plastics material capable of positioning in contact with one of the two largest faces of the sheet material during use, wherein a portion of the outer surface of the plastics material is exposed, such that the plastics material can be replaced, wherein the base layer comprises one or more sealing regions adjacent to the first and/or second protective regions the or each sealing region being adapted to cover one or more of the remaining exposed faces of the sheet material when suitably folded, wherein the or each sealing region is provided with releasable fastening means to enable the or each sealing region to be fastened releasably to a corresponding surface of the base layer when the fibre web is suitable folded.

2. A fibre web as claimed in claim 1, further comprising a third region separating the first and second regions and joined to both regions so that the third region covers a face separating the two largest faces of the sheet material.

3. A fibre web as claimed in claim 2, wherein the base layer forming the first and/or second and/or third regions is a laminate of woven fibre.

4. A fibre web as claimed in claim 2 wherein the base layer comprises one or more sealing regions adjacent to the first and or second protective regions the or each sealing region being adapted to cover one or more of the remaining exposed faces of the sheet material when suitably folded.

5. A fibre web as claimed in claim 1, wherein the region of overlapping fibre web is secured to the base layers by stitching and/or thermobonding.

6. A fibre web as claimed claim 5, wherein the or each sealing region is provided with releasable fastening means to enable the or each sealing region to be fastened releasably to a corresponding surface of the base layer when the fibre web is suitable folded.

7. A fibre web as claimed in claim 1, wherein both the first and second protective regions include a second layer of plastics material.

8. A fibre web as claimed claim 7, wherein the or each sealing region is provided with releasable fastening means to enable the or each sealing region to be fastened releasably to a corresponding surface of the base layer when the fibre web is suitable folded.

9. A fibre web as claimed in claim 1, wherein the plastics material is corrugated plastics material.

10. A fibre web as claimed in claim 1, wherein the base layer is formed from woven synthetic fibre.

11. A fibre web as claimed in claim 1, wherein the base layer is coated.

12. A fibre web as claimed in claim 1, wherein the fibre web is provided with one or more handles or loops to facilitate lifting and handling of the fibre web when it contains the sheet material.

13. A fibre web as claimed in claim 1 wherein said base layer comprises polypropylene.

14. A fibre web as claimed in claim 1 wherein the at least one region of overlapping fibre web is part of the base layer.

15. A fibre web as claimed in claim 1 wherein the at least one region of overlapping fibre web is formed as a separate web of material relative to the base layer.

* * * * *

UNITED STATES PATENT AND TRADEMARK OFFICE

CERTIFICATE OF CORRECTION

PATENT NO. : 7,980,761 B2
APPLICATION NO. : 11/909967
DATED : July 19, 2011
INVENTOR(S) : Andrew Fulcher et al.

It is certified that error appears in the above-identified patent and that said Letters Patent is hereby corrected as shown below:

On title page, item 75 Inventors,
replace "Fultcher"
with "Fulcher"

Signed and Sealed this
Twenty-seventh Day of March, 2012

David J. Kappos

David J. Kappos
*Director of the United States Patent and Trademark Office*